US005977961A

United States Patent [19]

Rindal

[11] Patent Number: 5,977,961

[45] Date of Patent: Nov. 2, 1999

[54] METHOD AND APPARATUS FOR AMPLITUDE BAND ENABLED ADDRESSING ARRAYED ELEMENTS

[75] Inventor: Abraham E. Rindal, Fremont, Calif.

[73] Assignee: Sun Microsystems, Inc., Mountain View, Calif.

[21] Appl. No.: 08/665,763

[22] Filed: Jun. 19, 1996

[51] Int. Cl.[6] ..... G09G 5/00

[52] U.S. Cl. ..... 345/208; 345/204; 345/55

[58] Field of Search ..... 345/173, 87, 100, 345/98, 60, 61, 62, 55, 74

[56] References Cited

U.S. PATENT DOCUMENTS

| | | | |
|---|---|---|---|
| 4,543,572 | 9/1985 | Tanaka et al. | 340/723 |
| 5,436,635 | 7/1995 | Takahara et al. | 345/92 |
| 5,519,414 | 5/1996 | Gold et al. | 345/208 |

*Primary Examiner*—Matthew Luu
*Assistant Examiner*—Jeff Piziali
*Attorney, Agent, or Firm*—Flehr Hohbach Test Albritton & Herbert LLP

[57] ABSTRACT

Arrayed display pixels are coupled such that all row pixels are coupled together by a row conductive element and all column pixels are coupled together by a column conductive element. The row-coupled pixels are driven by first and second row drivers and the column-coupled pixels are driven by first and second column drivers, a total of four drivers in all. The drivers each output time-varying signals of different frequencies. The vertical scan rate is determined by the frequency differential in the signals output by the two row drivers, and the horizontal scan rate frequency is determined by the frequency differential in the signals output by the two column drivers. The absolute frequencies of the four signals are set proportional to the propagation delay of the medium through which the driver signals travel. The invention implements a pixel enabling signal using the beat-frequency difference between two driver source signals that propagate through a pixel string from opposite ends of the string. The driver difference signal dwells sufficiently long on each pixel location to deliver sufficient energy to turn the pixel on or off. Video information to be displayed is used to modulate at least one of the row drivers and one of the column drivers.

20 Claims, 12 Drawing Sheets

METHOD AND APPARATUS FOR AMPLITUDE BAND ENABLED ADDRESSING ARRAYED ELEMENTS

FIELD OF THE INVENTION

The invention relates to driver architecture for addressing elements in a matrix such as an array of pixels in a video display, and more particularly to architecture reducing the number of drivers while maintaining if not improving display contrast performance.

BACKGROUND OF THE INVENTION

Matrixed arrays of addressable components are commonly found in applications ranging from computer memories (e.g., random access memory or "RAM") to flat panel video displays including plasma and liquid crystal displays ("LCDs"). The storage elements in a memory unit, or the viewable pixel elements in a display are arrayed in rows and columns. Within the array, each element had a unique address that is specified in terms of horizontal row and vertical column location, e.g., the element at row X, column Y, or element (X,Y).

FIG. 1 depicts a conventional prior art video display 10 as comprising a plurality of pixels (shown as squares) that are arranged along a y-axis in M rows and along an x-axis in N columns. The M×N pixels are identifiable by their co-ordinates, e.g., pixel (1,1), pixel (2,1) through pixel $(X_M,Y_N)$.

In the prior art, each pixel in a horizontal row is coupled-together electrically and is driven by a row driver. Thus, the uppermost row of pixels (1,1) through (N,1) is driven by a row driver DX1, the next row of pixels (1,2) through (N,2) is driven by a row driver DX2, and so forth. Similarly, each pixel in a vertical column is coupled together and is driven by a common column driver. Thus, the first vertical column comprising pixels (1,1), (1,2) through $(1,X_M)$ is driven by column driver DY1, and so forth. Thus, one disadvantage of the prior art configuration of FIG. 1 is that an array of M rows and N columns will require M+N drivers. Thus, in a high resolution 1280×1024 pixel array, 2,304 separate drivers are required.

In addition to requiring a very large number of drivers, prior art arrays tend to suffer from poor contrast. Assume that pixel (4,7) is to be driven, e.g., is to be "illuminated" or rendered "active". In the prior art scheme shown in FIG. 1, it is necessary to simultaneously cause row driver DX7 to be active, and to cause column driver DY4 to be active. By "active" it is meant that each driver will output a logic level signal that represents an active state, for example a logical level "1" pulse. The only pixel in the array subjected to the combined logic level effects of two pulse trains will be the pixel at the intersection defined by (4,7). Ideally a pixel subjected simultaneously to two pulse train signals is active, whereas all pixels subjected to one or no pulse trains will be inactive. As used herein, it will be understood that the term "driver" refers not merely to the output transistor(s) that physically drive the given row or column, but will also include the source of the logic signals that are output by the driver.

But pixels adjacent to the illuminated pixel tend to become somewhat active due to their exposure to at least one of the pulse trains. For example, pixel (3,7) does not receive a pulse from a column driver, but will receive one logic-level pulse from row driver DX7. The effect is to diminish the "bright/dim" contrast between the desired active pixel and the adjacent pixels.

It is known in the art to enhance the contrast ratio by providing an active dedicated thin film transistor ("TFT") for each pixel in the array. Rather than actively drive an entire row of pixels to activate a single pixel in the row, only the dedicated TFT associated with the target pixel is driven. The resultant so-called "active" (as contrasted with "passive") display exhibits excellent contrast ratio, but is expensive to produce due to the large number of drivers that are required (e.g., M×N drivers, or one driver per pixel) and due to the relatively low yield. The active display is essentially a single large integrated circuit measuring perhaps 7.5" (190 mm)×6.5" (165 mm), and a handful of inoperative pixels in the screen can render the display unacceptable to a user.

There is a need for a mechanism to drive addressable elements in an array that will reduce the total number of drivers required. Further, in a video display environment, such mechanism should enhance the contrast ratio attainable from a passive display without incurring high manufacturing cost and low yield.

The present invention disclosed such a mechanism and a method for driving addressable array elements.

SUMMARY OF THE PRESENT INVENTION

In a display comprising pixels arrayed in M rows and N columns, pixels in every row are coupled together by a row conductive element having first and second ends, and pixels in every column are coupled together by a column conductive element having first and second ends. The row-coupled pixels are driven by first and second row drivers ($DX_1$, $DX_2$) coupled respectively to the first and second ends of the row conductive element. The column-coupled pixels are driven by first and second column drivers ($DY_3$, $DY_4$) coupled respectively to the first and second ends of the column conductive element. Thus, a total of only four drivers is used to address M×N elements in the array.

Each driver outputs a time-varying signal of a different frequency, and the driver signals propagate through the associated conductive element. The amplitude of any one driver is about half the total amplitude needed to activate or turn on a pixel. The time-varying voltage seen by a pixel in a row is determined by the amplitude and frequency ($\omega_1$, $\omega_2$) of row drivers $DX_1$, $DX_2$, and by the propagation time needed for the signals to reach the pixel. Similarly, column pixels see time-varying voltage signals determined by the amplitude and frequency ($\omega_3$, $\omega_4$) of column drivers $DY_3$, $DY_4$, and by the relevant propagation time.

The present invention implements a pixel enabling signal using the beat-frequency difference between two driver source signals that propagate through a pixel string from opposite ends of the string. The driver difference signal dwells sufficiently long on each pixel location to deliver sufficient energy to turn the pixel on or off. Vertical scan rate is determined by frequency differential ($\omega_1$-$\omega_2$), and horizontal scan rate frequency differential ($\omega_3$-$\omega_4$). The absolute frequencies $\omega_1$, $\omega_2$, $\omega_3$, $\omega_4$ are set proportional to the propagation delay of the medium through which the signals from $DX_1$, $DX_2$, $DY_3$, $DY_4$ travel. Preferably the frequencies of the driver signals coupled to the same conductive element are approximately comparable to the inverse of the end-end propagation time associated with the conductive element. Video information to be displayed is used to modulate at least one of the row drivers and one of the column drivers.

Other features and advantages of the invention will appear from the following description in which the preferred embodiments have been set forth in detail, in conjunction with the accompanying drawings.

DETAILED DESCRIPTION OF THE PREFERRED EMBODIMENT

Figure 1:
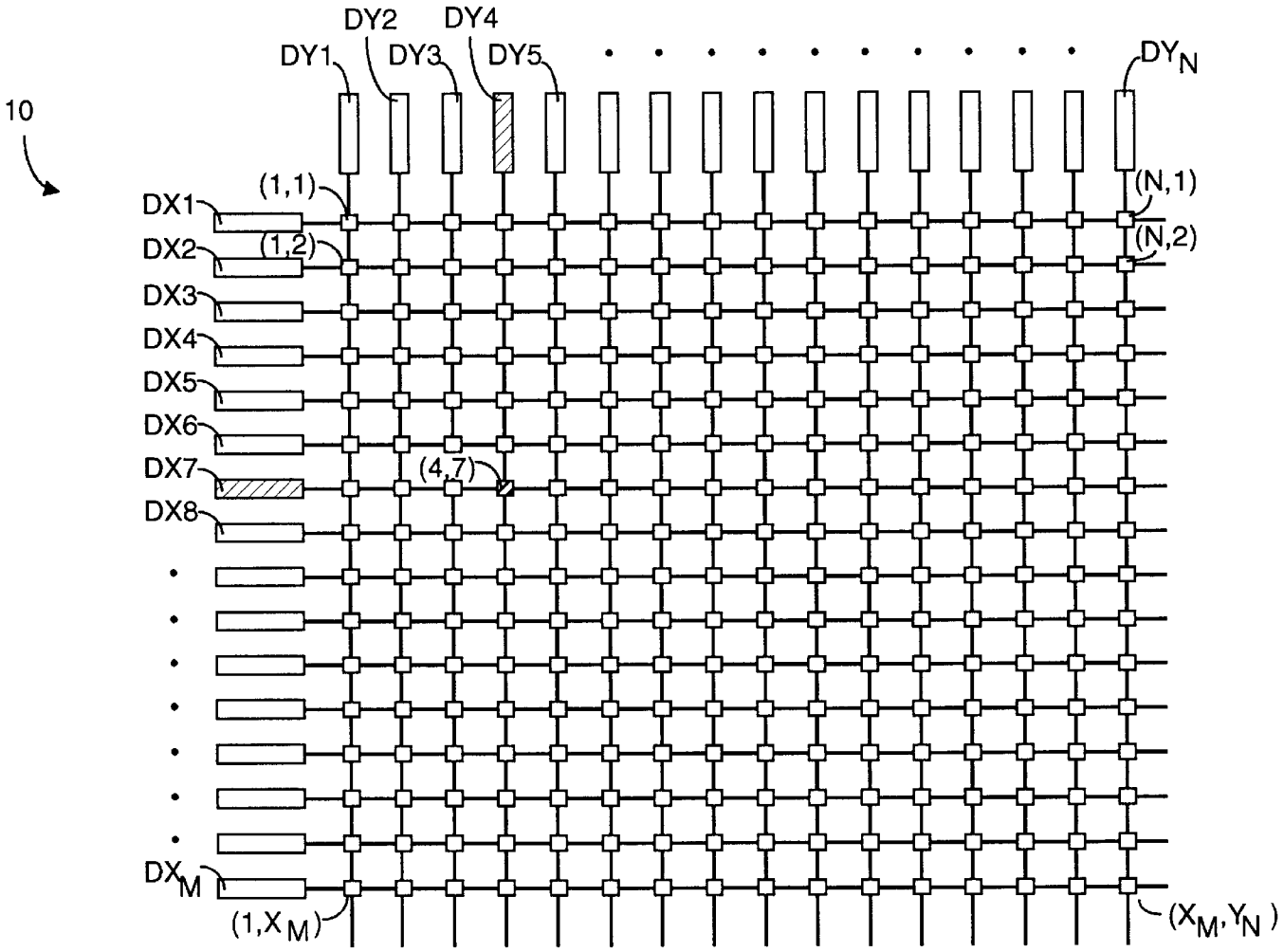
FIGURE 1 (PRIOR ART)
FIG. 1 is a block diagram of a display comprising M×N pixels, driven by a total of M+N drivers, according to the prior art.
Figure 2:
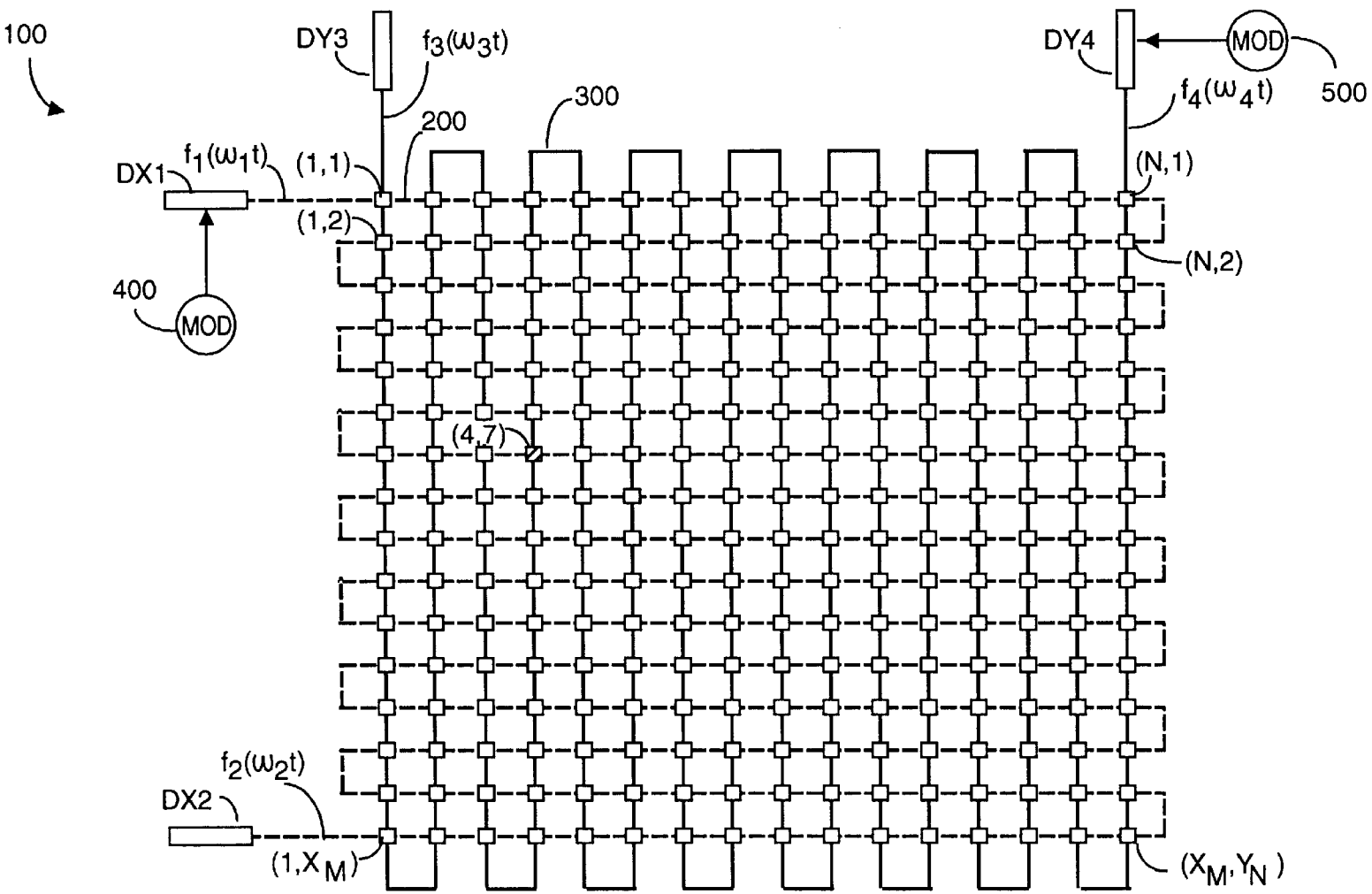
FIG. 2 is a block diagram of a display comprising M×N pixels, driven by a total of four drivers, according to the present invention.

FIG. 2 depicts an array 100 as comprising a plurality of pixels (again shown as squares) that are arranged along a y-axis in M rows and along an x-axis in N columns. Similar to FIG. 1, the M×N pixels are identifiable by their co-ordinates, e.g., pixel (1,1), pixel (2,1) through pixel ($X_M$,$Y_N$). However, in array 100, each horizontal pixel is coupled together by a common row conductive element 200, and each vertical pixel is coupled together by a common column conductive element 300. By "coupled together" it is meant that electromagnetic energy carried by the conductive element is coupled to the pixels. Such coupling may be ohmic, e.g., a direct electrical connection between the conductive element and pixels, or non-ohmic in that it suffices that the energy transfer occurs, perhaps by electrostatic coupling or otherwise.

In FIG. 2 row conductive element 200 is drawn in phantom to make it more readily distinguished from column conductive element 300. In the embodiment shown, conductive elements 200 and 300 are each serpentine-like in shape and will have a known end-to-end length determined by the physical dimensions of array 100. The physical dimensions of array 100, in turn, are affected by the individual pixel size and the spaced-apart distance between pixels.

The row-coupled pixels are driven by first and second row drivers ($DX_1$, $DX_2$) coupled respectively to the first and second ends of the row conductive element 200. Similarly, column-coupled pixels are driven by first and second column drivers ($DY_3$, $DY_4$) coupled respectively to the first and second ends of the column conductive element 300. As explained herein, a total of only four drivers (DX1, DX2, DY3, DY4) is used to address the M×N elements in the array.

Each driver outputs a time-varying signal of a different frequency, and the driver signals propagate through the associated conductive element. Thus, driver DX1 outputs a driver signal $f1(\omega_1 t)$, driver DX2 outputs $f2(\omega_2 t)$, driver DY3 outputs $f3(\omega_3 t)$, and driver DY4 outputs driver signal $f4(\omega_4 t)$. The amplitude of any given driver is about half the magnitude needed to activate a pixel. Thus, a pixel is activated by a combination of signals from two drivers, one coupled to either end of the conductive element associated with the pixel.

The velocity electromagnetic waves such as driver signals, to propagate through a material (e.g., the conductive elements and associated materials) is proportional to the speed of light and is given by:

$$V_{\text{prop}} = \frac{\text{velocity of light}}{\sqrt{(\text{dielectric constant})}}$$

in which the dielectric constant (or permittivity) is that of the conductive elements and associated materials (or the equivalent). The velocity of light is $3\times10^8$ m/sec, and the dielectric constant of commonly used display materials will be in the range of about 3 to 10. Thus, the driver signals will travel along the conductive elements at a rate of perhaps $1.5\times10^8$ m/sec.

Because the driver signal is propagating so rapidly past each pixel, there would be insufficient dwell time to transfer enough energy to light-up any pixel completely. For example, present display technologies scan (and acti-vate or light-up) pixels at a rate of perhaps 30 ns per pixel. Even with the serpentine configuration of FIG. 2, in a 30 cm×30 cm panel, an activation pulse would only spend 2 ns on each column or row.

Further, simply directly coupling a single drive signal to a string of pixels would result in all pixels being briefly partially activated (i.e. lit up) as the activating pulse passed over them. Consequently, it would be impossible to selectively light up only some of the pixels in this string because the same activating signal as it propagates down the string would pass over all pixels equally.

These two problems of how to select individual pixels and how to use an otherwise too rapidly propagating drive signal are solved in the present invention by using the beat-frequency difference between two driver signals as the pixel enabling signal. This difference signal dwells sufficiently long on each pixel location to deliver or transfer sufficient energy to turn the pixel on (activate) or off (de-activate). The time-varying voltage seen by a pixel in a row is determined by the amplitude and frequency the two row driver signals $f1(\omega_1 t)$ and $f2(\omega_2 t)$ output by row drivers $DX_1$, $DX_2$, and by the propagation time needed for the signals to reach the pixel. Similarly, column pixels see time-varying voltage signals determined by the amplitude and frequency of the two column driver signals $f3(\omega_3 t)$ and $f4(\omega_4 t)$ output by column drivers DY3, DY4. The time-varying voltage seen by a pixel in a column is also determined by the propagation time needed for signals to reach the pixel.

According to the present invention, the display horizontal scan rate is determined by the frequency differential ($\omega_1$-

$\omega_2$), and the vertical scan rate frequency differential ($\omega_3$-$\omega_4$). Further, the absolute frequencies $\omega_1$, $\omega_2$, $\omega_3$, $\omega_4$ are set proportional to the propagation delay of the medium through which the signals from $DX_1$, $DX_2$, $DY_3$, $DY_4$ travel. Video information to be displayed on display 100 is used to modulate at least one of the row drivers and one of the column drivers. Thus in FIG. 2, modulator 400 is coupled to driver DX1 and modulator 500 is coupled to driver DY4. Of course modulation could instead or in addition be coupled to drivers DX2 and/or DY3.

Because the absolute frequencies $\omega_1$, $\omega_2$, $\omega_3$, $\omega_4$ are set proportional to the propagation delay of the medium, the resultant composite voltages resulting from the sum of the two row-driven voltages and from the sum of the two column-driven voltages will vary with time and with physical location on the conductive element being driven.

Figure 3A:
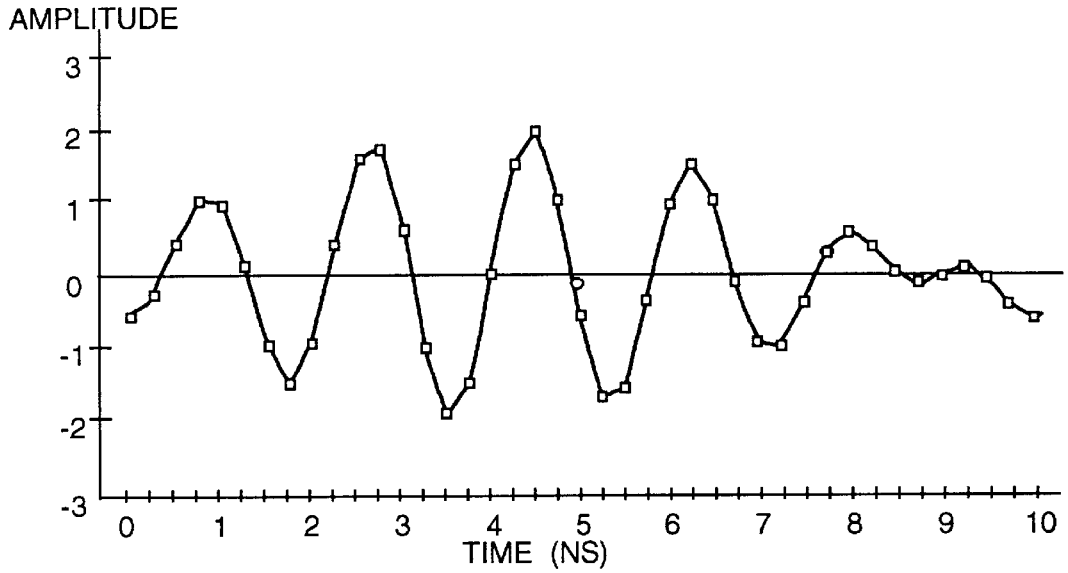
FIGS. 3A and 3B depict the time-dependent driver signal voltage present at different pixels along a conductive element, according to the present invention.
Figure 3B:
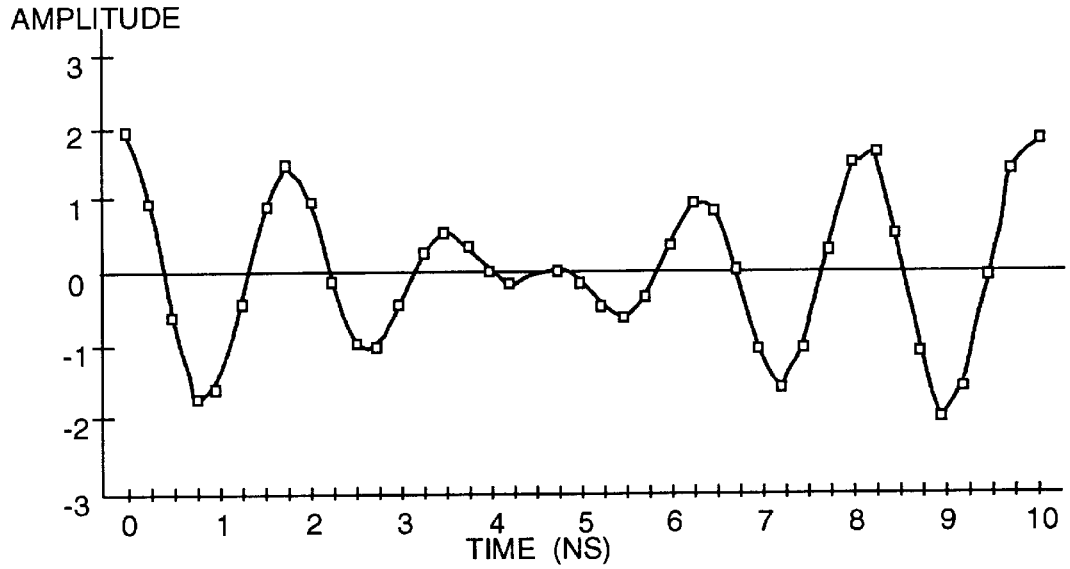

Consider now the pixel driver waveforms shown in FIGS. 3A and 3B. Assume that nine pixels are connected-together in series by a conductive element having a voltage driver coupled to each end of the conductive element, whose propagation time end-to-end is about 1 ns. Assume that adjacent pixels are spaced apart a distance 18 mm, and that the voltage drivers output respective signals f1($\omega_1$t) and f2($\omega_2$t), wherein each signal is 1 V peak-peak, e.g., a voltage peak-peak magnitude that is too low for an individual driver signal to activate a pixel.

According to the present invention, the period of each voltage driver signal is made approximately comparable to the conductive element propagation time. By comparable it is meant that the period is within about ±100%, the period being twice the propagation time in the present example. Thus, if the conductive element propagation time is 1 ns, let $\omega_1$=500 MHz, and $\omega_2$=600 MHz. This frequency relationship ensures a phase difference between f1($\omega_1$t) and f2($\omega_2$t) sufficient to cause each pixel to see a combined driver signal that differs significantly at each location in the pixel string. Since the two driver signals are originating from different locations relative to any given pixel, their signal summation will differ at any particular pixel location at the same instant of time.

FIG. 3A shows the time-dependent voltage present at the first pixel in the string, e.g., the pixel closest to driver signal f1($\omega_1$t), and FIG. 3B depicts the voltage present at a pixel mid-way between the first and last pixel in the pixel string. Note that these voltages have the form of an amplitude modulated sinewave in which the high frequency carrier has an amplitude "envelope" representing the low frequency difference between the two driver signals. In this example, the envelope frequency is indeed about 100 MHz, e.g., (600 MHz−500 MHz).

According to the present invention, the rate of change of the envelope is independently set by selecting the frequency difference between the two driver signals. However, the absolute frequency of the two driver signals is set proportional to the propagation delay of the medium through which they travel. In this manner, individual pixels are addressed at a reasonably slow rate.

It is apparent from examination of FIGS. 3A and 3B that voltage maxima traverse left and right with a period that is proportional to the difference in periods between the two driver voltage waveforms, e.g., $1/\omega_1$ and $1/\omega_2$. Indeed, this phenomena is present even if the display is implemented not with discrete row and column conductive elements, but with overlying planes.

Figure 4:
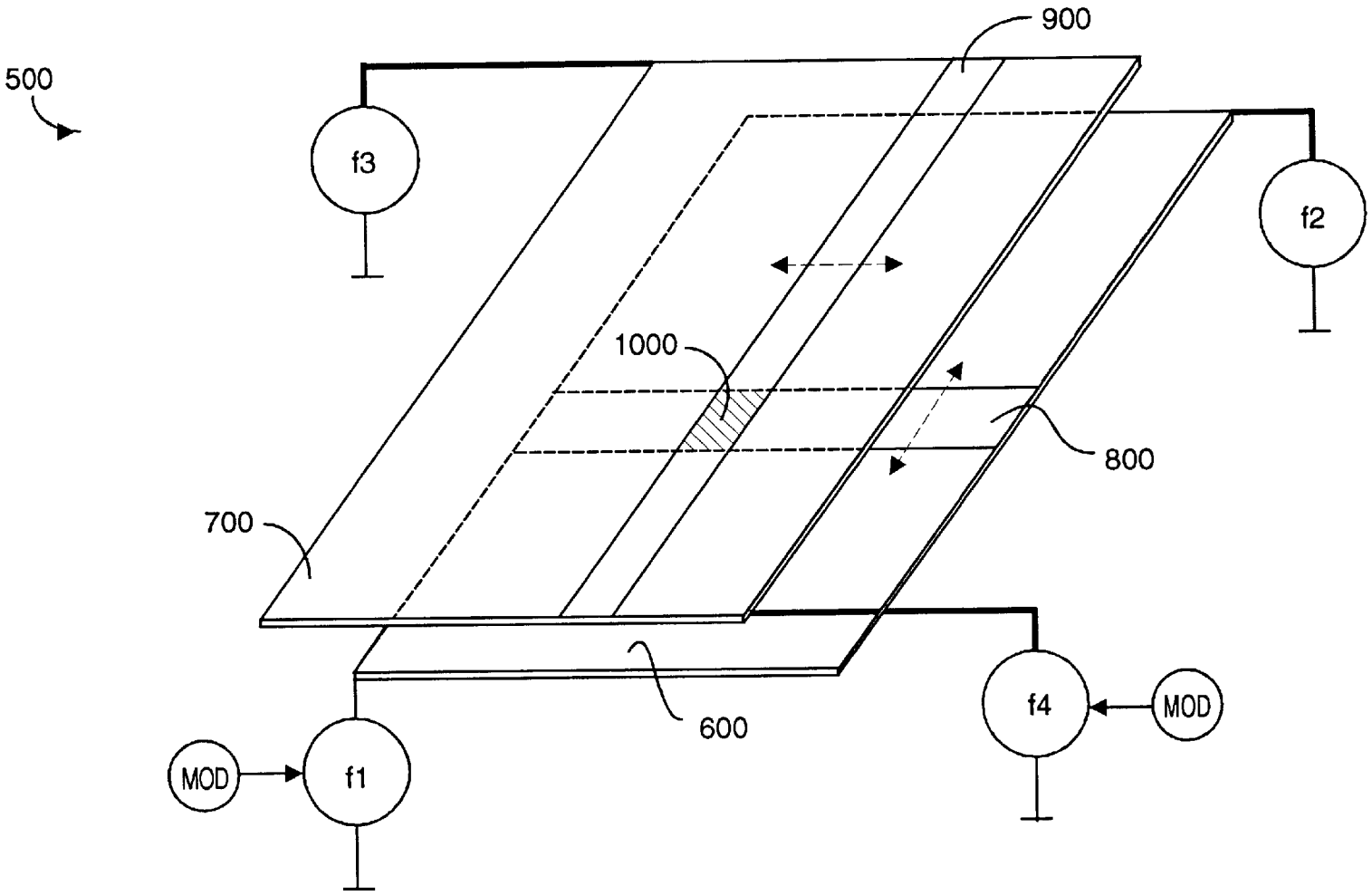
FIG. 4 depicts an embodiment in which time-dependent drivers are coupled between first and second conductive planes, according to the present invention.

FIG. 4, for example, depicts a display 500 as comprising a first plane 600 containing pixels that are addressed by drivers f1 and f2 and an overlying second plane 700 containing pixels addressed by drivers f3 and f4. (For brevity, the FIG. 4 notation f1 is understood to stand for f1($\omega_1$t), etc.). In this embodiment, first plane 600 is the row conductive element, whose first and second ends are two opposite diagonal portions of the plane. Similarly, plane 700 is the column conductive element, whose first and second ends are two opposite diagonal portions of the plane.

In FIG. 4, the driver signals are selected according to the above-described criteria. As the f1 and f2 signals vary with time, a horizontal band 800 of pixels is addressed, and as the f3 and f4 signals vary with time, a vertical band 900 of pixels is addressed. The time-motion of these two bands is depicted in FIG. 4 by phan-tom double-arrowed lines. Only pixels lying at the time-varying intersection 1000 of moving bands 800, 900 will be active at any given time.

Regardless of whether serpentine conductive elements, or conductive planes are utilized in a video display, the preferred enabling waveform is not a sinusoid, but rather a digital pulse train. However, the above-described principals still apply. The width of the digital pulses will be proportional to the pixel area that is to be enabled.

Assume again that nine pixels (spaced-apart a distance 110 cm) are series-connected by a conductive element having a digital voltage driver coupled to each end. Let each voltage driver have an output impedance of R Ω, and let the voltage drivers output respective digital pulse signals f1(t) and f2(t) that are perhaps 5 V peak-peak. Assume that the end-end conductive element propagation time is now 6 ns, and thus the time to propagate from pixel to adjacent pixel is about 0.75 ns. Let f1(t) and f2(t) each output a pulse train having logic "1" level pulses for about 1 ns.

In the present digital example, at any pixel location along the pixel string, the voltage will be the continuous sum of the two source voltage waveforms. Assume that a pixel is active (e.g., on) when the voltage at the pixel node location exceeds about 3 VDC. Let the period of f1(t) be 6 ns, and the period of f2(t) be 5.64 ns, such that the period differential yields a scanning period of 94 ns. Thus, $1/\text{period}_{diff}$=1/(5.64 ns)−1/(6 ns). These waveform characteristics demonstrate the presence of a beat frequency that is lower than the two source frequencies.

Figure 5:
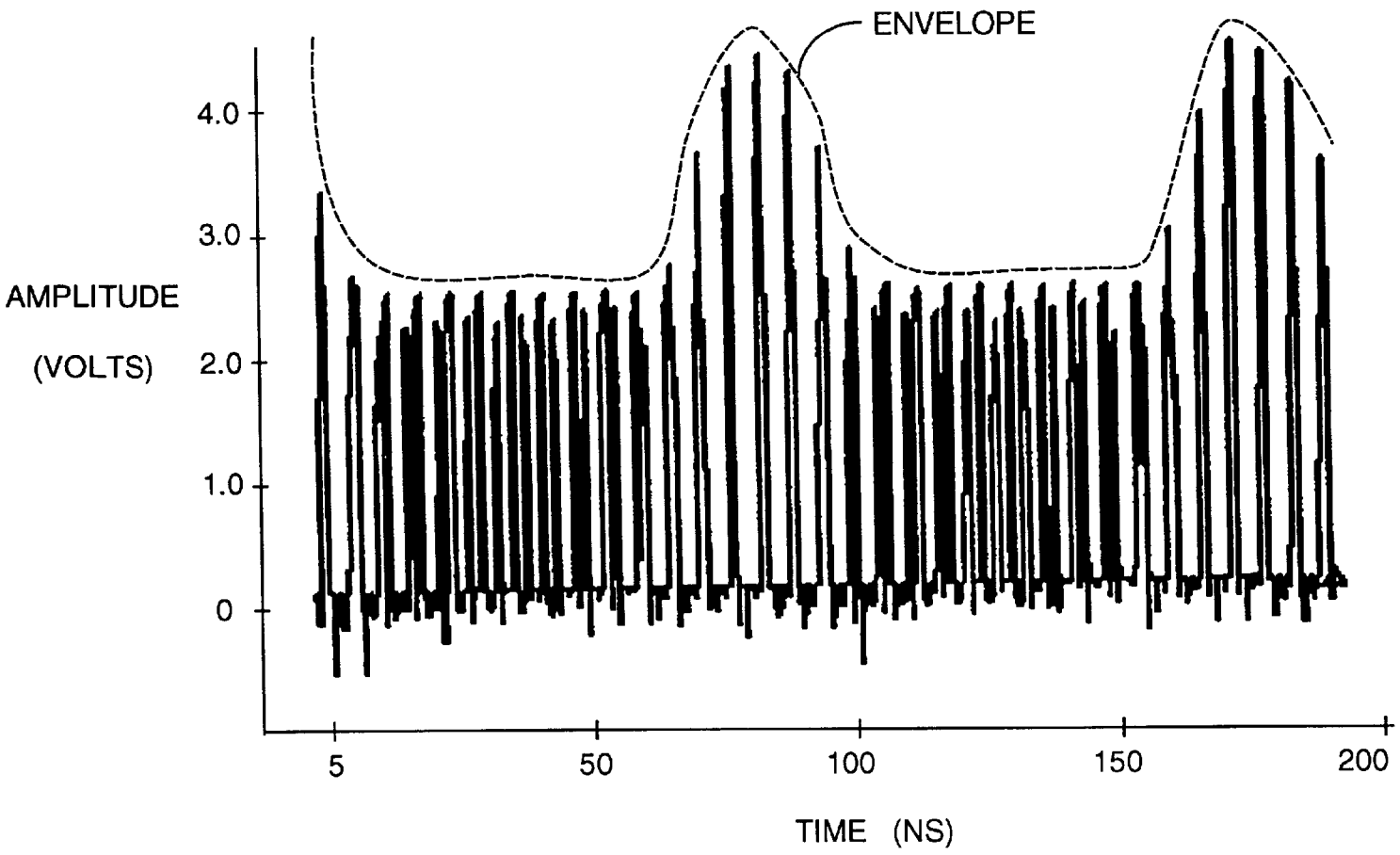
FIG. 5 depicts the amplitude band type envelope produced when beating digital pulse trains whose period differential corresponds to a desired envelope period, according to the present invention.

FIG. 5 depicts the composite voltage waveform at the first node (and also the last node) in the exemplary string of nine pixels. Note that two unique locations experience a voltage exceeding about 3 VDC at any given time, these locations being symmetrical about the central pixel node. Note in FIG. 5 that the envelope of the high frequency pulses has a period of about 94 ns, e.g., a period corresponding to the differential in the frequency of the two input voltage sources f1(t) and f2(t).

Figure 6:
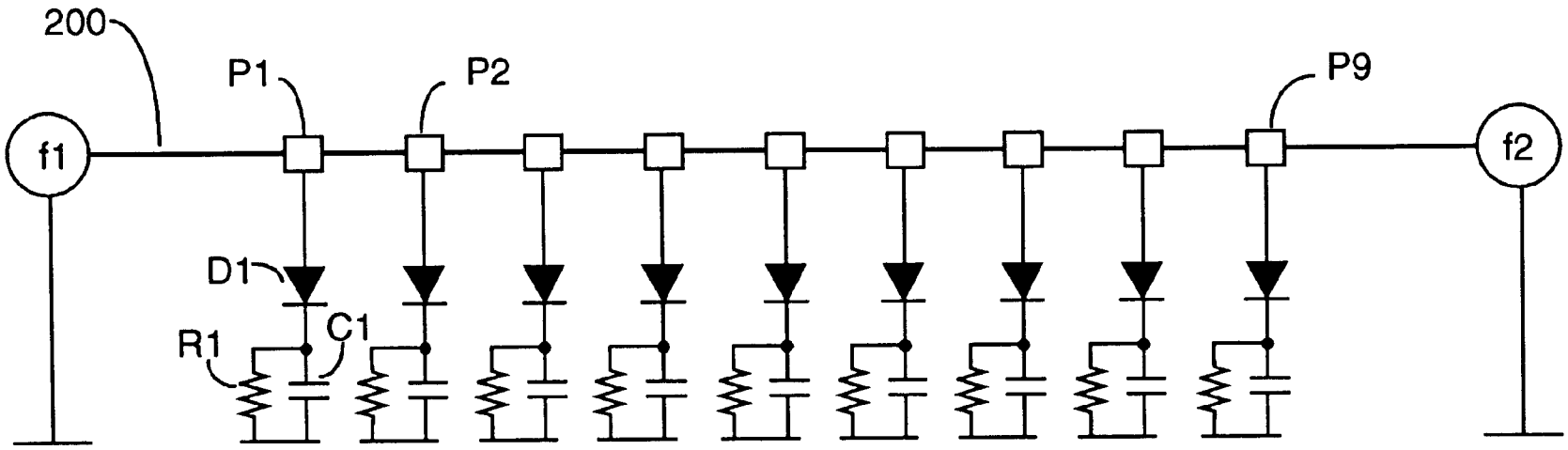
FIG. 6 depicts the optional use of rectifying diodes in a display, according to the present invention.

For a cathode ray tube ("CRT") type scanning system, the vertical frame rate is scanned at about 60 Hz, which means the differential in frequency between the f1(t) and f2(t) voltage sources should be 60 Hz. In practice, the summed or composite signal at each pixel node may require rectification to produce a continuous pulse that turns on the pixel. If required, a common diode $D_N$ may be implemented per pixel $P_N$, as shown in FIG. 6. The $R_NC_N$ low pass filter associated with each diode rectifier may be implemented using stray capacitance and resistance in the array structure. In an existing TFT LCD, each pixel diode may simply be the emitter-base junction of the existing thin film transistor. In any event, it will be appreciated that fabricating a diode rectifier per pixel (if needed) is less burdensome than implementing an active TFT driver per LCD pixel, in terms of cost, yield, and overall reliability.

Alternatively, the diode may be implemented per row or per column, replacing a row or column driver, instead of replacing a pixel driver, if a separate propagation path is used.

Figure 7A:
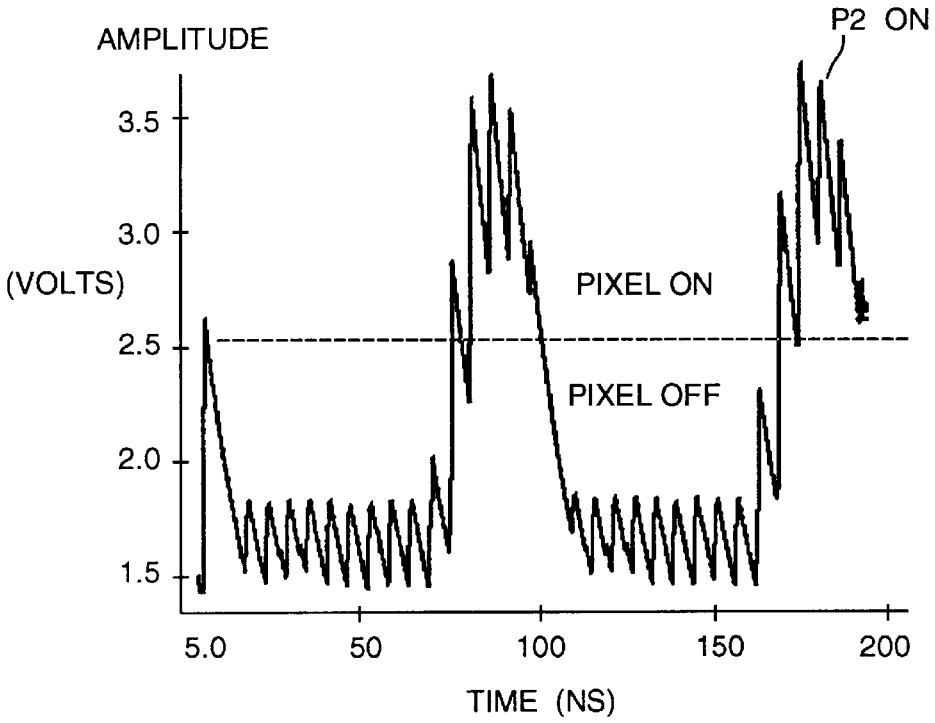
FIGS. 7A, 7B and 7C depict rectified driver signals present at different pixel node locations for the exemplary configuration of FIG. 6, according to the present invention.
Figure 7B:
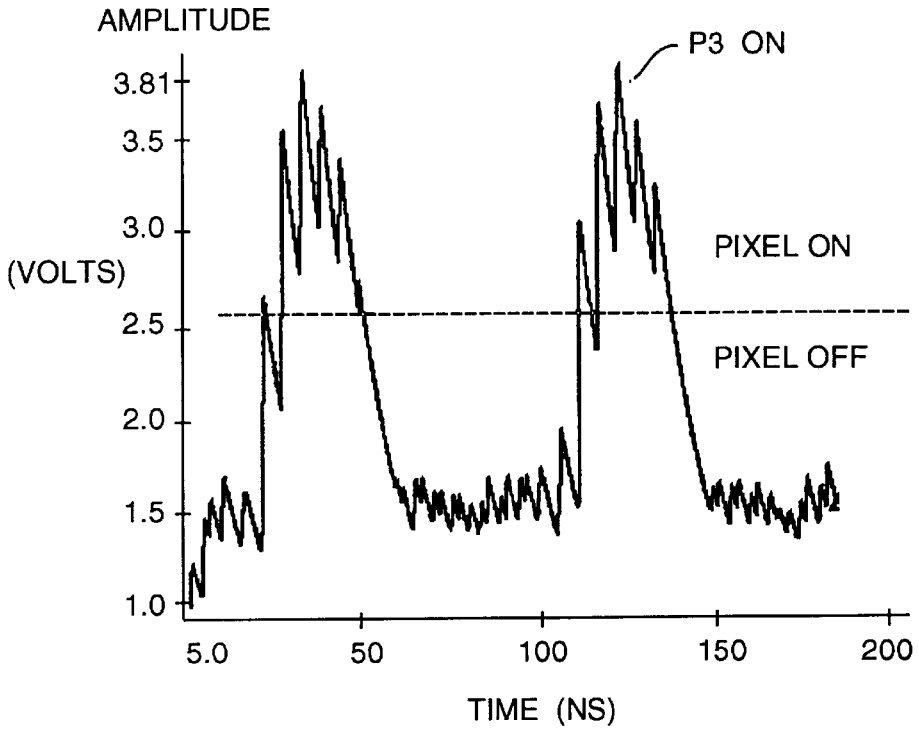
Figure 7C:
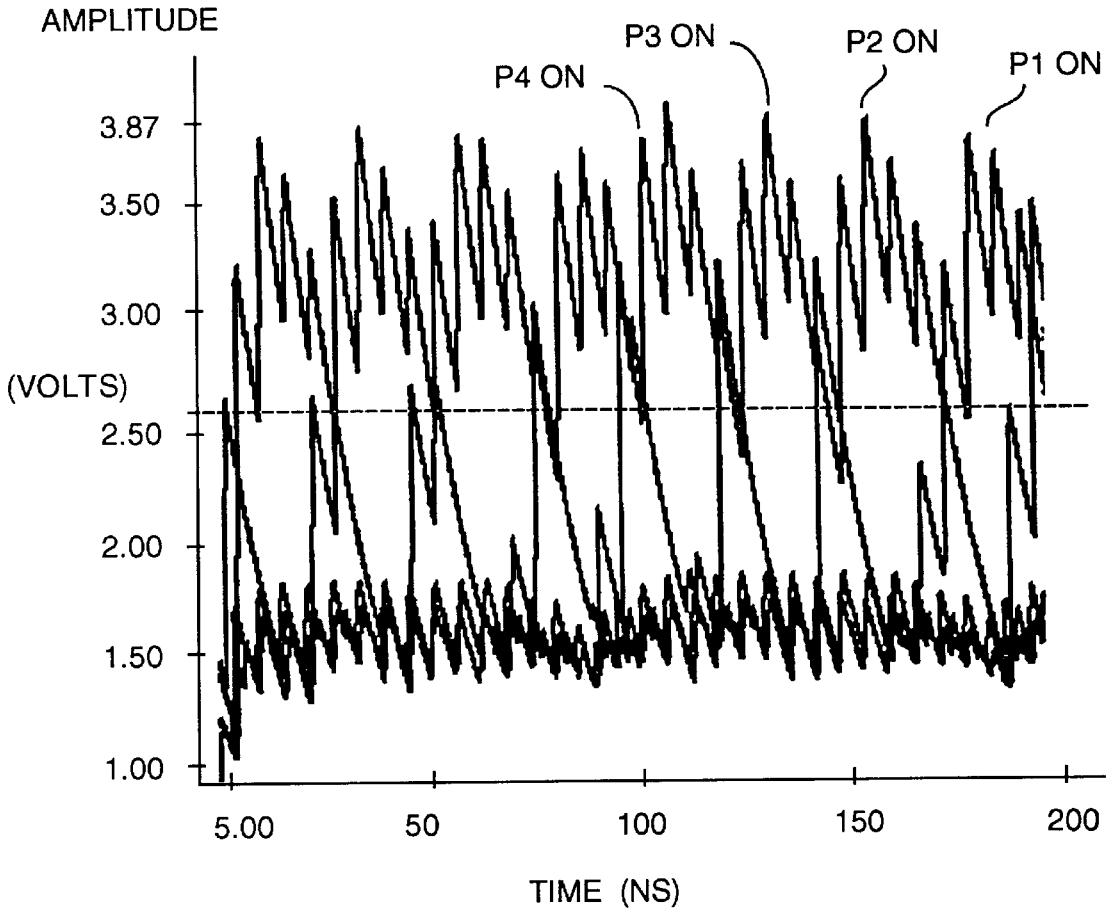

FIGS. 7A and 7B depict rectified driver voltages at pixels P2 and P3 in the simplified nine-pixel configuration shown in FIG. 6. When the rectified voltage is "high", slightly above 2.5 VDC in this example, the pixel is active or turned on, and when the voltage is "low" or below about 2.5 VDC, the pixel is inactive or turned off. The period of the amplitude peaks is again about 94 ns, as intended. A comparison between FIGS. 7A and 7B shows that pixel P3 turns on at a different time than pixel P2. FIG. 7C depicts the sequential activation of pixels P4, P3, P2, P1 for the simplified configuration of FIG. 6. Note that the pixels are sequentially turned on using only two drivers, but respond as though they were discretely addressed using a plurality of drivers, as in the prior art.

Figure 8A:
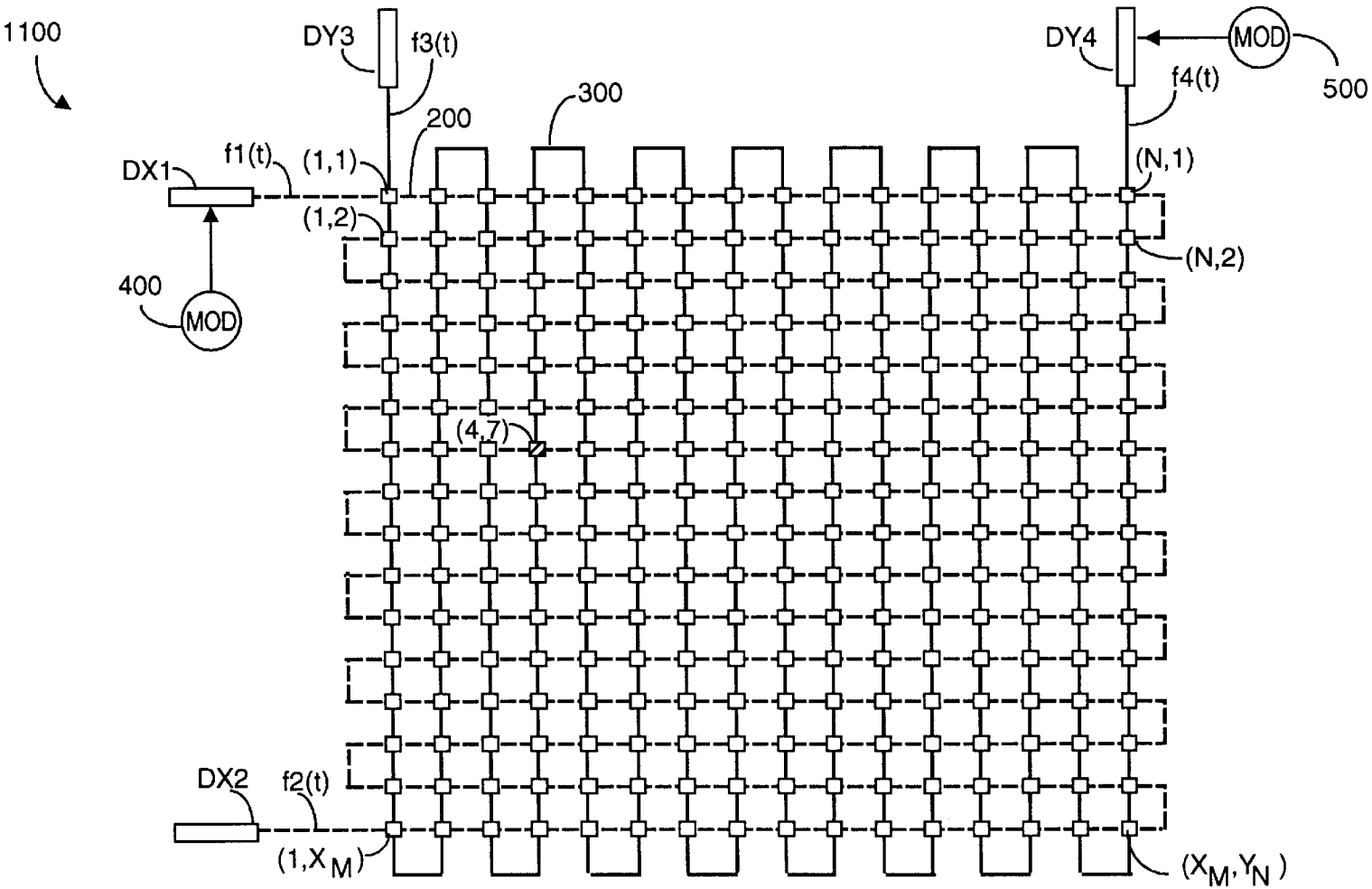
FIG. 8A is a block driver of a display comprising M×N pixels, driven by a total of four digital drivers, according to the present invention.
Figure 8B:
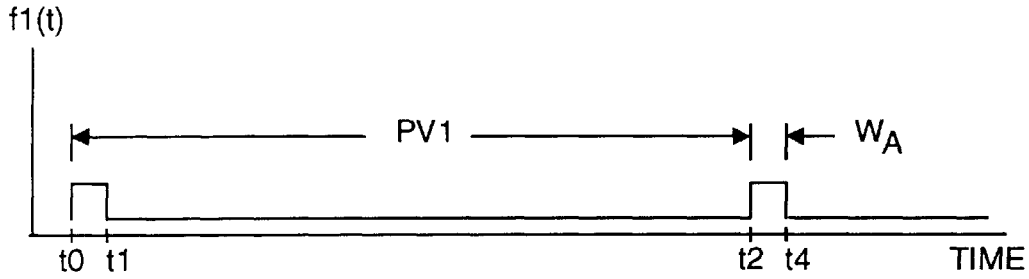
FIGS. 8B, 8C, 8D, 8E depict preferred time relationships between the digital drive signals for the embodiment of FIG. 8A.
Figure 8C:
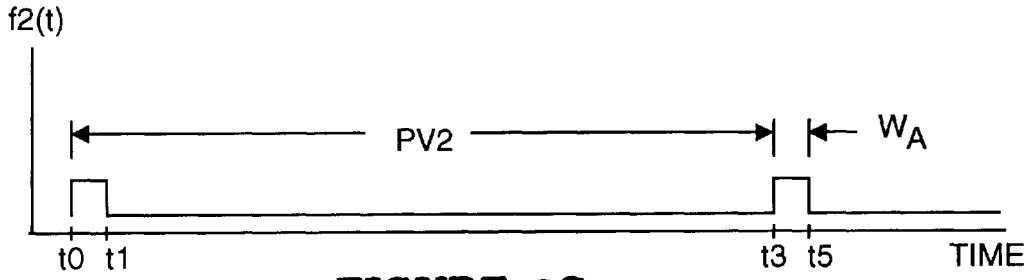
Figure 8D:
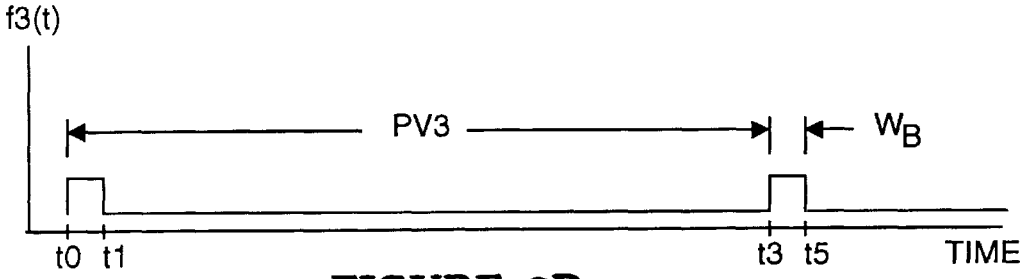
Figure 8E:
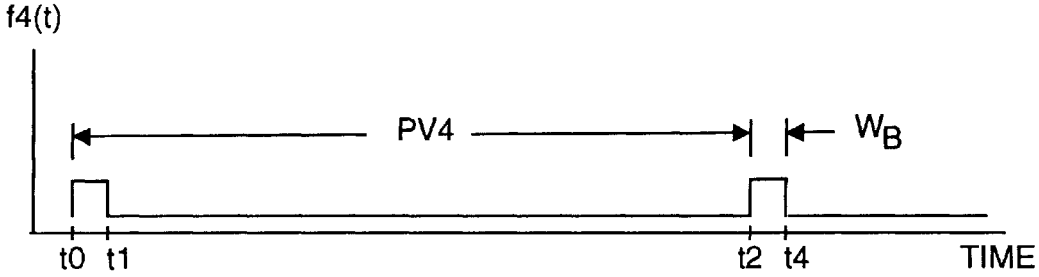

FIG. 8A depicts a preferred embodiment of a display 1100 that is similar to what was depicted in FIG. 2, except that row drivers DX1, DX2 and column drivers DY3, DY4 each output respective digital pulse train driver signals f1(t), f2(t), f3(t), f4(t) rather than sinusoidal waveforms. Each of the driver signals produce half the voltage magnitude required to enable a pixel. As shown, conductive elements 200 and 300 preferably are perpendicular serpentine grids of wire.

The periods of signals f1(t) and f2(t), PV1 and PV2 respectively, preferably are separated by a time period Y measured in Hz, and the amplitude of f1(t) and/or f2(t) may be amplitude modulated by the desired video signal. The periods of signals f3(t) and f4(t), PV3 and PV4 respectively, preferably are separated by a time period X measured in Hz, and either or both of these signals may also be modulated by the desired video signal. Further, the relative roles of each pair of drivers outputting the driver signals may be interchanged, if desired. The phase of each driver signal may be controlled to simplify video memory timing, if desired. Such phase control is known in the art and will now be detailed herein.

In a typical video display, information is read out from a video random access memory ("VRAM") sequentially under the control of a vertical and horizontal synchronization signal. The beam or image refresh sweeps from the top left corner of the screen, moving from left to right and from top to bottom. Each pixel on the screen has a corresponding byte of information in the VRAM. In the present invention, the peak of the scanning enable band occurs when the sum of the two source drivers are both high. In FIG. 8A, by setting the phase of DX1 to start at the peak voltage at T=0 and by setting DX2 to start at the midpoint between peaks, the amplitude band will be a maximum on row #1 at T=0, given that the propagation time of the serpentine row electrode is ½ the period of DX2. The pulse that starts DX1 is the equivalent of the vertical sync signal in a conventional display. In common digital logic, the vertical sync signal would reset a counter that generates the DX1 signal. In an identical fashion, horizontal sync is used to synchronize the start of the DY3 and DY4 sources.

The frequency separation between f1(t) and f2(t), e.g., the respective repetition rates, is set by the desired vertical refresh rate for display 1100. In present day display systems, the vertical refresh rate typically is in the range of about 60 Hz to about 120 Hz, although other frequencies could of course be implemented by properly selecting the frequency separation.

FIGS. 8B, 8C, 8D and 8E depict the timing relationships between f1(t), f2(t), f3(t) and f4(t) for the embodiment of FIG. 8A. The combined f1(t) and f2(t) signals sequentially enable each row of pixels, and the combined f3(t) and f4(t) signals sequentially enable each column of pixels. The amplitude of any or all of these driver signals is modulated by the video information to be displayed, to define whether an addressed (e.g., enabled) pixel is lit or not lit.

The period PV1 of f1(t) preferably is approximately equal to $2*N*T_{prop}$, where N is the number of rows, and $T_{prop}$ is the propagation delay. The period difference (PV1-PV2) is set by the desired vertical scanning rate for the display. For a vertical scan rate having a 60 Hz refresh cycle, (PV1-PV2)=1/60 (sec.)≈16.7 ms. The period difference (PV3-PV4) is set by the desired horizontal scanning rate, which is typically determined by the type of display element used, e.g., LCD, plasma, cold cathode, etc. For a 10 KHz horizontal scanning rate, (PV3-PV4)=1/10,000≈100 μs.

The pulse width $W_a$ associated with f1(t) and f2(t) pulses is the row enable pulse width, and will be comparable to the propagation time of the physical width of the display, 15" (38 cm), for example. For a 38 cm wide display, $W_a$ would be about 2.5 ns. The pulse width $W_b$ associated with f3(t) and f4(t) pulses is the column enable pulse width, and will be comparable to the propagation delay of the physical height of the display, 11.5" (29.2 cm), for example. For a 29.2 cm high display having typical dielectric materials, $W_b$ would be about 2 ns. As the display area is increased, the drive circuitry implementing DX1, DX2, DX3, DX4 becomes simplified because the pulse widths $W_a$ and $W_b$ become wider, e.g., longer in duration.

Figure 9:
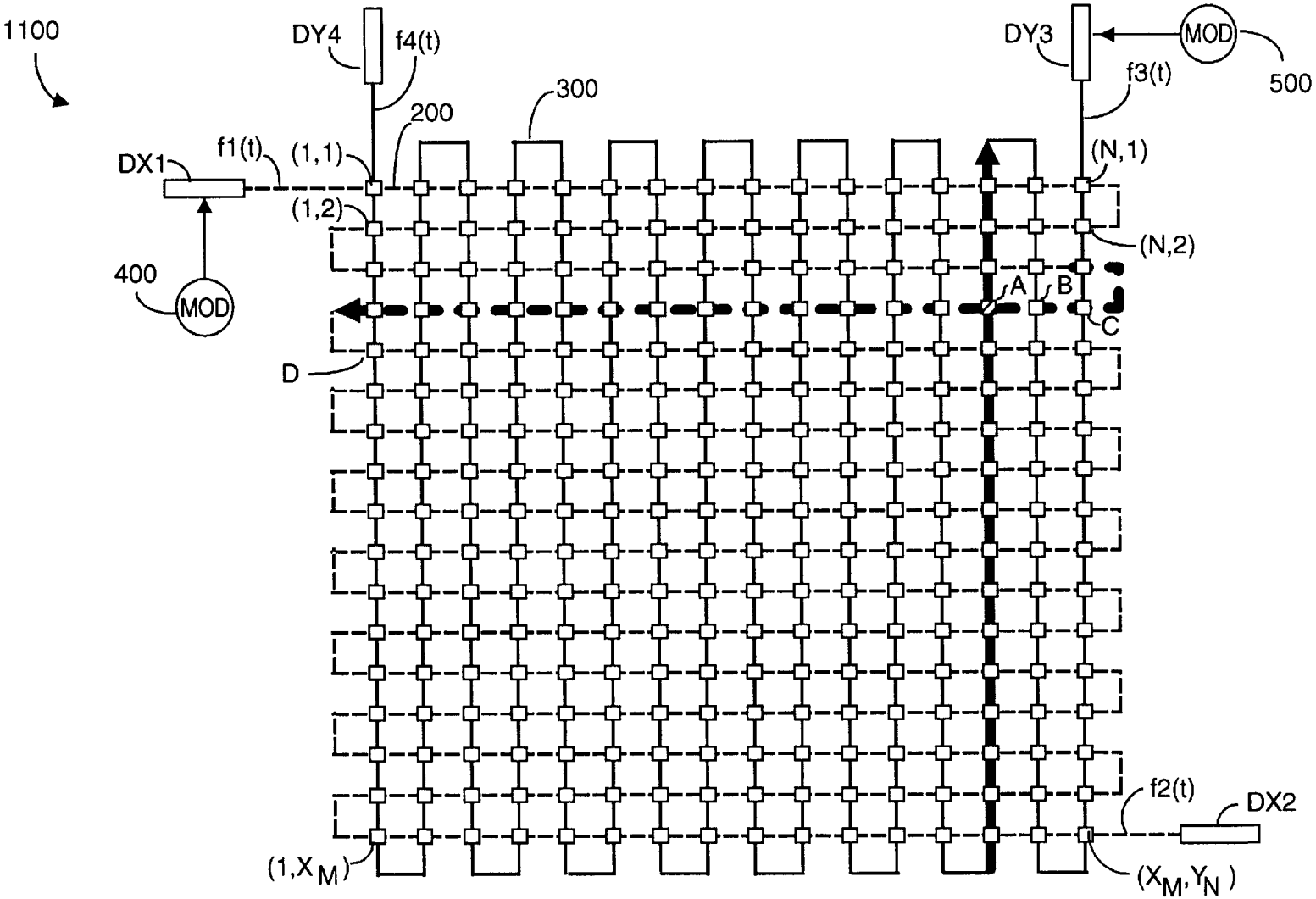
FIG. 9 depicts a sample scanning sequence for a display using four drivers, according to the present invention.

FIG. 9 depicts a sample scanning sequence, according to the present invention, and depicts the travel of the combined row and column select amplitude enable bands. The bands are depicted as heavy row and column lines, and will be found at a location where the amplitude envelope of f1(t)+f2(t) is high, and where the amplitude envelope of f3(t)+f4(t) is high. In this example, it is assumed that f1(t) is a higher frequency than f2(t), and thus the scanning direction is away from the higher frequency source toward the lower frequency source. Similarly, it is assumed that f4(t) is a higher frequency than f3(t), and thus the scanning direction is also in a direction away from f4(t) toward the lower frequency f3(t). In FIG. 9, pixel A is presently lit up, and pixel B will be the next pixel addressed, after which pixel C and then pixel D will be addressed.

Figure 10:
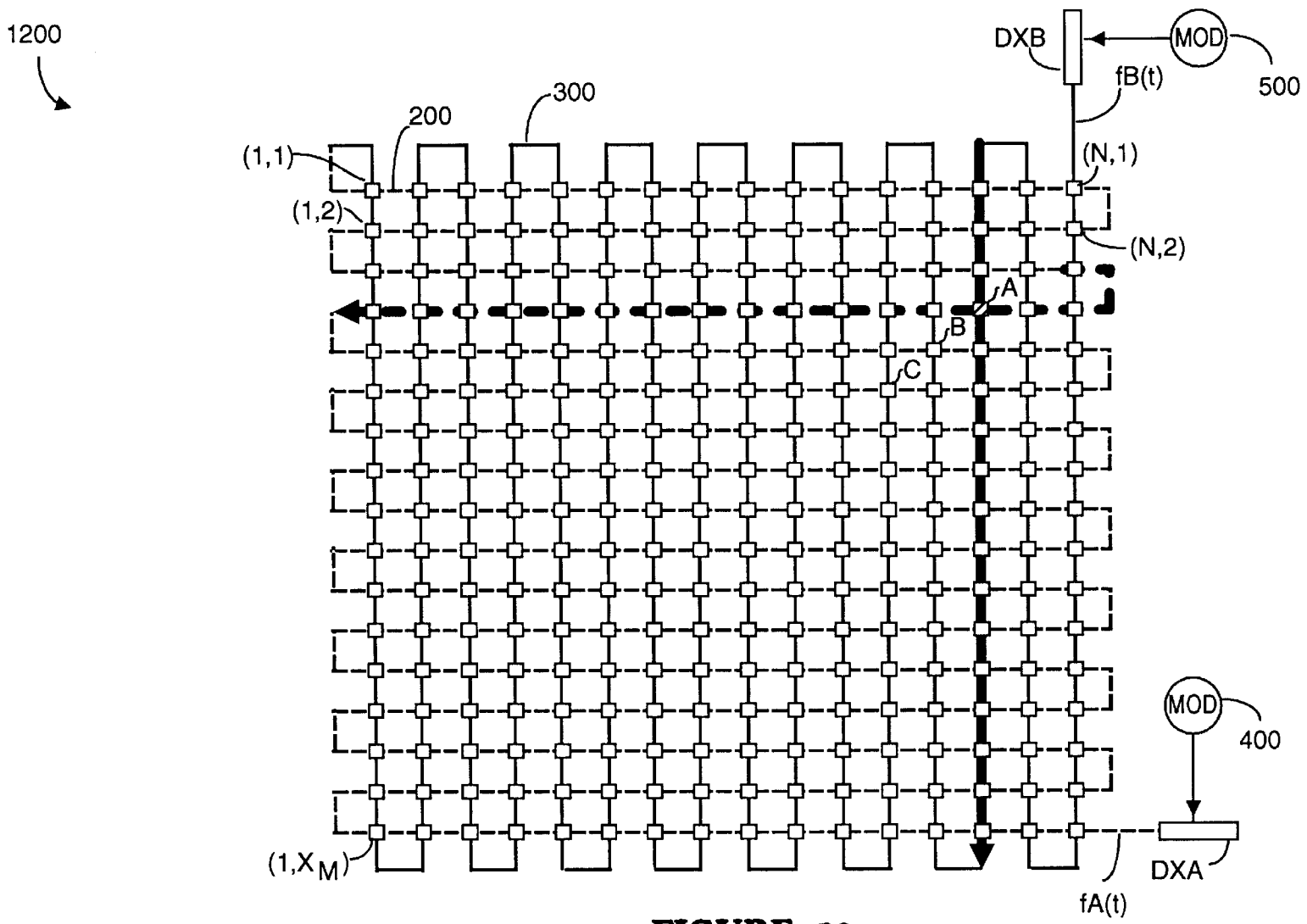
FIG. 10 depicts a sample scanning sequence for a display using two drivers, according to the present invention.

FIG. 10 depicts another embodiment of the present invention, wherein only two drivers DXA outputting fA(t) and DXB outputting fB(t) are used to drive display 1200. The preferably serpentine conductive elements 200 and 300 are series-coupled at their non-driven ends. In this embodiment, the active pixel is scanned diagonally, e.g., pixel A, then pixel B, then pixel C. The starting phase of fA(t) relative to fB(t) defines which diagonal "line" is scanned.

In the various described embodiments of the present invention, it is to be understood that the display in question may be monochrome or color, and may be implemented using techniques other than liquid crystal, for example, plasma, cold cathode, among other technologies. In a color display, the pixels shown in the various embodiments herein may be considered to be separate arrays of red, or green, or blue pixels. Alternatively, the pixels in an array in an embodiment described herein may be considered to be alternating combinations of red, green, and blue pixels, e.g., different colored pixels in the single array shown in the figures. In the various LCD embodiments, the present invention provides a response and contrast ratio commensurate with that provided by more expensive active matrix displays, TFT for example. However, this performance is attained without the thousands of drivers needed in prior art implementations, and without the expense and yield difficulties associated with implementing literally millions of perpixel thin film transistors. In a plasma or cold cathode display where each of thousands of drivers must be relatively high voltage units, the cost savings provided by the present invention is even more dramatic.

The preferred embodiments have been described with respect to addressing any of M×N pixel elements arrayed in M rows and N columns in a display. In addition to the display types referred to earlier herein, the invention also has applicability with various emissive and reflective displays including electroluminescent units, light emitting diode units, micro-mirror units, among others. The present invention may be used with other devices that rely on addressed arrays, include imaging devices such as CCD video cameras, printers, touch screens, etc. Further, the present invention may also be used to address any of M×N storage cells in an array of RAM memory elements, or indeed to address other selectable elements similarly arrayed.

Modifications and variations may be made to the disclosed embodiments without departing from the subject and spirit of the invention as defined by the following claims.

What is claimed is:

1. A method for addressing a display comprising pixels arrayed in M rows and N columns, the method comprising:

(a) electromagnetically coupling together all pixels in each of said M rows;

(b) electromagnetically coupling together all pixels in each of said N columns;

(c) driving the row-coupled pixels coupled together in step (a) with first and second row drivers, coupled to drive respective first and second ends of said coupled together row-coupled pixels, and outputting respective row drive signals f1(t) and f2(t);

(d) driving the column-coupled pixels coupled together in step (b) with first and second column drivers, coupled to drive respective first and second ends of said coupled together column-coupled pixels, and outputting respective column drive signals f3(t) and f4(t);

wherein at least one condition is met selected from a group consisting of (i) frequency of f1(t)≠frequency of f2(t), and frequency of f3(t)≠frequency of f4(t); and wherein said pixels in said display are enabled or disabled according to a beat frequency time-varying non-zero voltage magnitude determined by amplitude and frequency of said signals f1(t), f2(t), f3(3), f4(t) and by propagation time needed for said signals to reach a said pixel.

2. The method of claim 1, wherein at least one of steps (a) and (b) is carried out by providing a conductive element that couples together said pixels.

3. The method of claim 1, wherein at least one of steps (a) and (b) is carried out by providing a conductive plane that couples together said pixels.

4. The method of claim 2, wherein the first and second drivers are coupled to opposite ends of said conductive element.

5. The method of claim 3, wherein the first and second drivers are coupled to diametrically opposite ends of said conductive plane.

6. The method of claim 1, wherein peak amplitude of any one of said signals f1(t), f2(t), f3(t) and f4(t) is less than a minimum magnitude required to enable a said pixel, and wherein at least one of said f1(t), f2(t), f3(t) and f4(t) has a characteristic selected from the group consisting of (i) said signal is a digital pulse train, and (ii) said signal is sinusoidal.

7. The method of claim 1, wherein vertical scan rate for said display is determined by a differential between frequency of said f1(t) and frequency of said f2(t).

8. The method of claim 7, wherein absolute frequency of said f1(t) and absolute frequency of said f2(t) are set proportional to propagation delay encountered by said f1(t) and by said f2(t).

9. The method of claim 1, wherein horizontal scan rate of said display is determined by a differential between frequency of f3(t) and frequency of said f4(t).

10. The method of claim 9, wherein absolute frequency of said f3(t) and absolute frequency of said f4(t) are set proportional to propagation delay encountered by said f3(t) and by said f4(t).

11. The method of claim 1, wherein said display is fabricated using a technique selected from the group consisting of (i) monochrome liquid crystal display, (ii) color liquid crystal display, (iii) plasma display, (iv) cold cathode display, (v) electroluminescent display, (vi) light emitting diode display, and (vii) micro-mirror display.

12. The method of claim 1, further comprising:

(e) coupling a video signal to modulate at least one signal selected from said f1(t), f2(t), f3(t) and f4(t).

13. A method for addressing a display comprising pixels arrayed in M rows and N columns, the method comprising:

(a) electromagnetically coupling together all pixels in each of said M rows with a row conductive element having first and second ends;

(b) electromagnetically coupling together all pixels in each of said N columns using a column conductive element having first and second ends, wherein said first end of said column conductive element is coupled to said second end of said row conductive element;

(c) driving the row-coupled pixels coupled together in step (a) with a first row driver outputting a row driver signal f1(t);

(d) driving the column-coupled pixels coupled together in step (b) with a first column driver outputting a column driver signal f4(t), wherein frequency of f4(t) ≠frequency of f1(t);

wherein said pixels in said display are enabled or disabled according to a beat frequency time-varying non-zero voltage magnitude determined by amplitude and frequency of said signals f1(t) and f4(t) and by propagation time needed for said signals to reach a said pixel.

14. The method of claim 13, wherein peak amplitude of each of said f1(t) and f4(t) is less than a minimum magnitude required to enable a said pixel, and wherein at least one of said f1(t) and said f4(t) has a characteristic selected from the group consisting of (i) said signal is a digital pulse train, and (ii) said signal is sinusoidal.

15. The method of claim 13, wherein said display has at least one characteristic selected from the group consisting of (i) a scan rate determined by a differential between frequency of said f1(t) and frequency of said f4(t), and (ii) wherein absolute frequency of said f1(t) and absolute frequency of said f4(t) are set proportional to propagation delay encountered by said f1(t) and by said f4(t).

16. A display, driveable with less than five drivers, comprising:

pixels arrayed in M rows and N columns;

a row conductive element electromagnetically coupling together all pixels in said M rows, said row conductive element having a first end and a second end;

a column conductive element electromagnetically coupling together all pixels in each of said N columns, said column conductive element having a first end and a second end;

a first row driver coupled to said first end of said row conductive element and outputting a first row drive signal f1(t);

a second row driver coupled to said second end of said row conductive element and outputting a second row drive signal f2(t), wherein frequency of f1(t) ≠frequency of f2(t);

a first column driver coupled to said first end of said column conductive element and outputting a first column drive signal f3(t); and a second column driver coupled to said second end of said column conductive element and outputting a second column drive signal f4(t), wherein f3(t)≠f4(t);

wherein at least one condition is met selected from a group consisting of (i) frequency of f1(t)≠frequency of f2(t), and frequency of f3(t)≠frequency of f4(t), and wherein at least one of said f1(t), f2(3), f3(t), and f4(t) is modulatable with a video signal to be displayed on said display;

wherein said pixels in said display are enabled or disabled according to a beat frequency time-varying non-zero voltage magnitude determined by amplitude and frequency of said signals f1(t), f2(t), f3(3), f4(t) and by propagation time needed for said signals to reach a said pixel.

17. The display of claim 16, wherein at least one of said row conductive element and said column conductive element includes a conductive plane that couples together said pixels.

18. The display of claim 16, wherein peak amplitude of any one of said signals f1(t), f2(t), f3(t) and f4(t) is less than a minimum magnitude required to enable a said pixel, and wherein at least one of said f1(t), f2(t), f3(t) and f4(t) has a characteristic selected from the group consisting of (i) said signal is a digital pulse train, and (ii) said signal is sinusoidal.

19. The display of claim 16, wherein said display has at least one scan characteristic selected from the group consisting of (i) a vertical scan rate determined by a differential between frequency of said f1(t) and frequency of said f2(t), and (ii) a horizontal scan rate of said display determined by a differential between frequency of f3(t) and frequency of said f4(t).

20. The display of claim 16, wherein absolute frequency of each said row drive signal and each said column drive signal is, respectively, set proportional to propagation delay encountered by each said row drive signal and each said column drive signal.

* * * * *